US009970134B2

(12) United States Patent
Baines et al.

(10) Patent No.: US 9,970,134 B2
(45) Date of Patent: May 15, 2018

(54) METHOD OF SIMULTANEOUSLY KNITTING OPPOSING SIDES OF AN ARTICLE OF FOOTWEAR

(71) Applicant: NIKE, Inc., Beaverton, OR (US)

(72) Inventors: Simon John Baines, Beaverton, OR (US); Stuart W. Dealey, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 344 days.

(21) Appl. No.: 14/994,815

(22) Filed: Jan. 13, 2016

(65) Prior Publication Data

US 2016/0208421 A1 Jul. 21, 2016

Related U.S. Application Data

(60) Provisional application No. 62/104,190, filed on Jan. 16, 2015.

(51) Int. Cl.
*D04B 1/22* (2006.01)
*A43B 1/04* (2006.01)
(Continued)

(52) U.S. Cl.
CPC ..... *D04B 1/22* (2013.01); *A43B 1/04* (2013.01); *D04B 7/04* (2013.01); *D04B 7/30* (2013.01); *D10B 2501/043* (2013.01)

(58) Field of Classification Search
CPC ... D04B 1/22; D04B 7/04; D04B 7/30; D04B 1/24; D04B 1/26; A43B 1/04
See application file for complete search history.

(56) References Cited

U.S. PATENT DOCUMENTS 1,888,172 A * 11/1932 Joha ..... A43B 1/02 36/11
1,910,251 A * 5/1933 Joha ..... D04B 1/24 12/142 S
(Continued)

FOREIGN PATENT DOCUMENTS

CN 202774344 U 3/2013
EP 1 130 146 A1 9/2001
(Continued)

OTHER PUBLICATIONS

International Search Report and Written Opinion for related International Application No. PCT/US2016/013216, dated Jul. 8, 2016 (22 pages).
(Continued)

*Primary Examiner* — Danny Worrell
(74) *Attorney, Agent, or Firm* — Brinks Gilson & Lione

(57) ABSTRACT

A method of knitting a knitted component for an article of footwear includes performing a pass of at least one yarn feeder along a longitudinal axis relative to first and second needle beds of a knitting machine. The method includes feeding at least one yarn with the at least one feeder during the pass. The method also includes forming, during the pass, a plurality of first loops with the first needles to define a first portion of the knitted component. The method further includes forming, during the pass, a plurality of second loops with the second needles to define a second portion of the knitted component. The first portion defines a medial side of an upper for the article of footwear. Additionally, the second portion defines a lateral side of the upper for the article of footwear.

20 Claims, 11 Drawing Sheets

(51) Int. Cl.
*D04B 7/04* (2006.01)
*D04B 7/30* (2006.01)

(56) References Cited

U.S. PATENT DOCUMENTS

| | | | | |
|---|---|---|---|---|
| 2,001,293 | A * | 5/1935 | Wilson | D04B 1/24 36/10 |
| 2,047,724 | A * | 7/1936 | Zuckerman | D04B 1/24 36/11 |
| 5,623,840 | A * | 4/1997 | Roell | D04B 1/123 66/190 |
| 8,522,577 | B2 | 9/2013 | Huffa | |
| 2005/0193592 | A1* | 9/2005 | Dua | A43B 1/04 36/45 |
| 2010/0154256 | A1 | 6/2010 | Dua | |
| 2012/0233882 | A1 | 9/2012 | Huffa et al. | |
| 2012/0234052 | A1* | 9/2012 | Huffa | D04B 1/123 66/64 |
| 2014/0137433 | A1 | 5/2014 | Craig | |
| 2016/0066651 | A1 | 3/2016 | Terai et al. | |

FOREIGN PATENT DOCUMENTS

| | | |
|---|---|---|
| TW | M490237 | 11/2014 |
| TW | 201446167 A | 12/2014 |
| WO | WO 2014/085206 A1 | 6/2014 |

OTHER PUBLICATIONS

Office Action, and English language translation thereof, in corresponding Taiwan Application No. 105101281, dated Nov. 7, 2016, 6 pages.

International Preliminary Report on Patentability in corresponding International Application No. PCT/US2016/013216, dated Jul. 27, 2017, 15 pages.

* cited by examiner

METHOD OF SIMULTANEOUSLY KNITTING OPPOSING SIDES OF AN ARTICLE OF FOOTWEAR

BACKGROUND

The present disclosure relates to an article of footwear and, more particularly, relates to a method of knitting opposing sides of an article of footwear.

Knitted components having a wide range of knit structures, materials, and properties may be utilized in a variety of products. As examples, knitted components may be utilized in apparel (e.g., shirts, pants, socks, jackets, undergarments, footwear), athletic equipment (e.g., golf bags, baseball and football gloves, soccer ball restriction structures), containers (e.g., backpacks, bags), and upholstery for furniture (e.g., chairs, couches, car seats). Knitted components may also be utilized in bed coverings (e.g., sheets, blankets), table coverings, towels, flags, tents, sails, and parachutes. Knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, knitted components may be incorporated into a variety of products for both personal and industrial purposes.

Knitting may be generally classified as either weft knitting or warp knitting. In both weft knitting and warp knitting, one or more yarns are manipulated to form a plurality of intermeshed loops that define a variety of courses and wales. In weft knitting, which is more common, the courses and wales are perpendicular to each other and may be formed from a single yarn or many yarns. In warp knitting, however, the wales and courses run roughly parallel and one yarn is required for every wale.

Although knitting may be performed by hand, the commercial manufacture of knitted components is generally performed by knitting machines. An example of a knitting machine for producing a weft knitted component is a V-bed flat knitting machine, which includes two needle beds that are angled with respect to each other. Rails extend above and parallel to the needle beds and provide attachment points for feeders, which move along the needle beds and supply yarns to needles within the needle beds.

SUMMARY

A method of knitting a knitted component for an article of footwear using a flat knitting machine is disclosed. The knitted component is formed of unitary knit construction. The flat knitting machine includes a first needle bed with a plurality of first needles arranged along a longitudinal axis, and the flat knitting machine includes a second needle bed with a plurality of second needles arranged along the longitudinal axis. The method includes performing a pass of at least one yarn feeder along the longitudinal axis relative to the first and second needle beds. The method also includes feeding at least one yarn with the at least one feeder during the pass. Moreover, the method includes forming, during the pass, a plurality of first loops with the first needles to define a first portion of the knitted component. Additionally, the method includes forming, during the pass, a plurality of second loops with the second needles to define a second portion of the knitted component. The first portion defines a medial side of an upper for the article of footwear, and the second portion defines a lateral side of the upper for the article of footwear.

Furthermore, a method of knitting a knitted component formed of unitary knit construction to have a first portion and a second portion is disclosed. The first portion is configured to at least partially define a first side of the article of footwear, and the second portion is configured to at least partially define a second side of the article of footwear. The first side is opposite the second side. The method includes providing a knitting machine having a plurality of first needles arranged in a first bed and a plurality of second needles arranged in a second bed. The first and second beds extend along an axis. The method further includes feeding at least one yarn to the first bed and forming a plurality of first loops with a first group of the first needles. The first loops are formed of unitary knit construction with a first neighboring area of the knitted component to at least partially define the first portion of the knitted component. The method further includes feeding the at least one yarn to the second bed and forming a plurality of second loops with a second group of the second needles. The second loops are formed of unitary knit construction with a second neighboring area of the knitted component to at least partially define the second portion of the knitted component. Feeding the at least one yarn to the first bed includes forming floats at a plurality of first intervening needles of the first bed. The first intervening needles are each disposed between pairs of the first needles in the first group. Moreover, feeding the at least one yarn to the second bed includes forming floats at a plurality of second intervening needles of the second bed. The second intervening needles are each disposed between pairs of the second needles in the second group. Additionally, the first group of the first needles is offset relative to the second group of the second needles along the axis.

Moreover, a method of knitting a knitted component formed of unitary knit construction to have a first portion and a second portion is disclosed. The first portion is configured to at least partially define a medial side of the article of footwear, and the second portion is configured to at least partially define a lateral side of the article of footwear. The method includes providing a flat knitting machine having a plurality of first needles arranged in a first bed and a plurality of second needles arranged in a second bed. The first and second beds extend along a longitudinal axis. The method also includes feeding at least one yarn to the first bed and forming a plurality of first loops with a first group of the first needles. The first needles of the first group are spaced apart at a first interval that is less than full-gauge. The first loops are formed of unitary knit construction with a first neighboring area of the knitted component to at least partially define the first portion of the knitted component. The method additionally includes feeding the at least one yarn to the second bed and forming a plurality of second loops with a second group of the second needles. The second needles of the second group are spaced apart at a second interval that is less than full-gauge. The second loops are formed of unitary knit construction with a second neighboring area of the knitted component to at least partially define the second portion of the knitted component. The first group of the first needles is offset relative to the second group of the second needles along the longitudinal axis.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Figure 1:
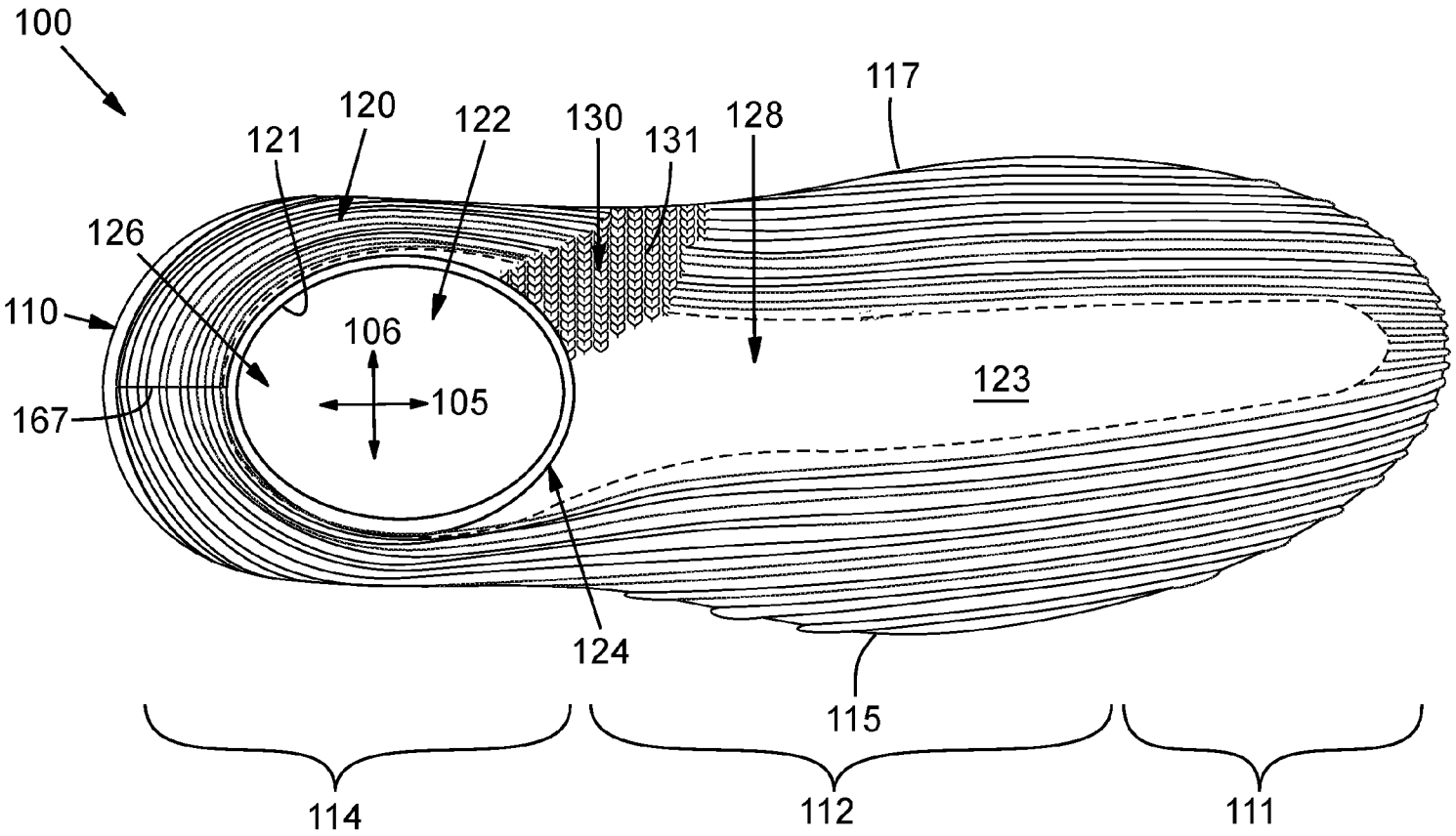
FIG. 1 is a top view of an article of footwear that includes a knitted component according to exemplary embodiments of the present disclosure.

The following discussion and accompanying figures disclose a variety of concepts relating to methods of knitting knitted components. These knitted components can be incorporated in an article of footwear in some embodiments. As will be discussed, different areas of the knitted component can be knitted substantially simultaneously. In some embodiments, these different areas can be formed simultaneously despite being detached from each other. Also, in some embodiments, these different areas can overlay and/or overlap during formation. Accordingly, these disclosed knitting methods can increase manufacturing efficiency for the article of footwear.

Referring initially to FIGS. 1-4, an article of footwear 100 is illustrated according to exemplary embodiments. Generally, footwear 100 can include a sole structure 110 and an upper 120. Upper 120 can receive the wearer's foot and secure footwear 100 to the wearer's foot whereas sole structure 110 can extend underneath upper 120 and support wearer.

For reference purposes, footwear 100 may be divided into three general regions: a forefoot region 111, a midfoot region 112, and a heel region 114. Forefoot region 111 can generally include portions of footwear 100 corresponding with forward portions of the wearer's foot, including the toes and joints connecting the metatarsals with the phalanges. Midfoot region 112 can generally include portions of footwear 100 corresponding with middle portions of the wearer's foot, including an arch area. Heel region 114 can generally include portions of footwear 100 corresponding with rear portions of the wearer's foot, including the heel and calcaneus bone. Footwear 100 can also include first and second sides. More specifically, footwear 100 can include a lateral side 115 and a medial side 117. Lateral side 115 and medial side 117 can extend through forefoot region 111, midfoot region 112, and heel region 114 in some embodiments. Lateral side 115 and medial side 117 can correspond with opposite sides of footwear 100. More particularly, lateral side 115 can correspond with an outside area of the wearer's foot (i.e. the surface that faces away from the other foot), and medial side 117 can correspond with an inside area of the wearer's foot (i.e., the surface that faces toward the other foot). Forefoot region 111, midfoot region 112, heel region 114, lateral side 115, and medial side 117 are not intended to demarcate precise areas of footwear 100. Rather, forefoot region 111, midfoot region 112, heel region 114, lateral side 115, and medial side 117 are intended to represent general areas of footwear 100 to aid in the following discussion.

Footwear 100 can also extend along various axes. For example, as shown in FIGS. 1-4, footwear 100 can extend along a longitudinal axis 105, a transverse axis 106, and a vertical axis 107. Longitudinal axis 105 can extend generally between heel region 114 and forefoot region 111. Transverse axis 106 can extend generally between lateral side 115 and medial side 117. Also, vertical axis 107 can extend substantially perpendicular to both longitudinal axis 105 and transverse axis 106. It will be appreciated that longitudinal axis 105, transverse axis 106, and vertical axis 107 are merely included for reference purposes and to aid in the following discussion.

Figure 2:
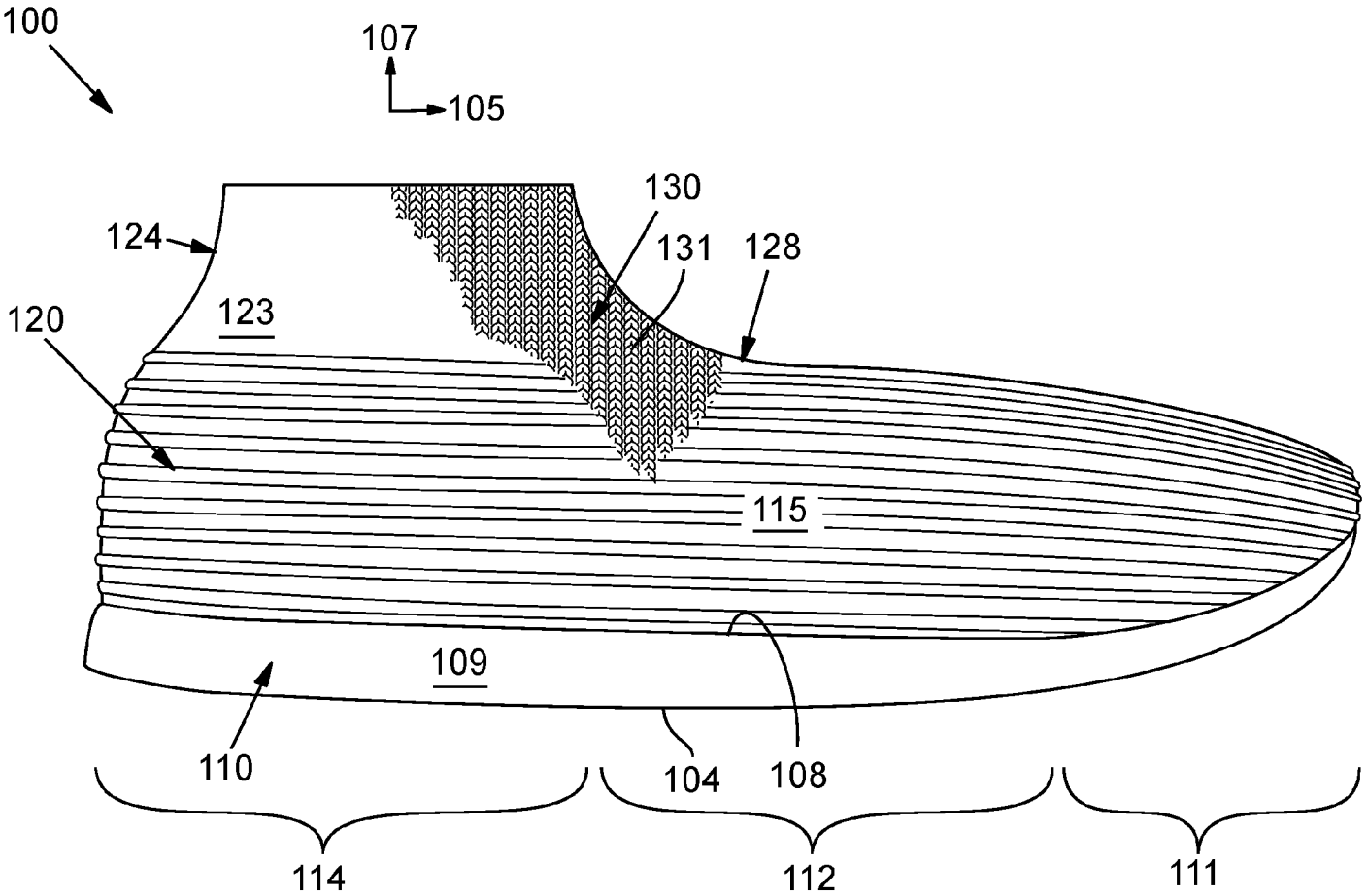
FIG. 2 is a lateral side view of the article of footwear of FIG. 1.
Figure 3:
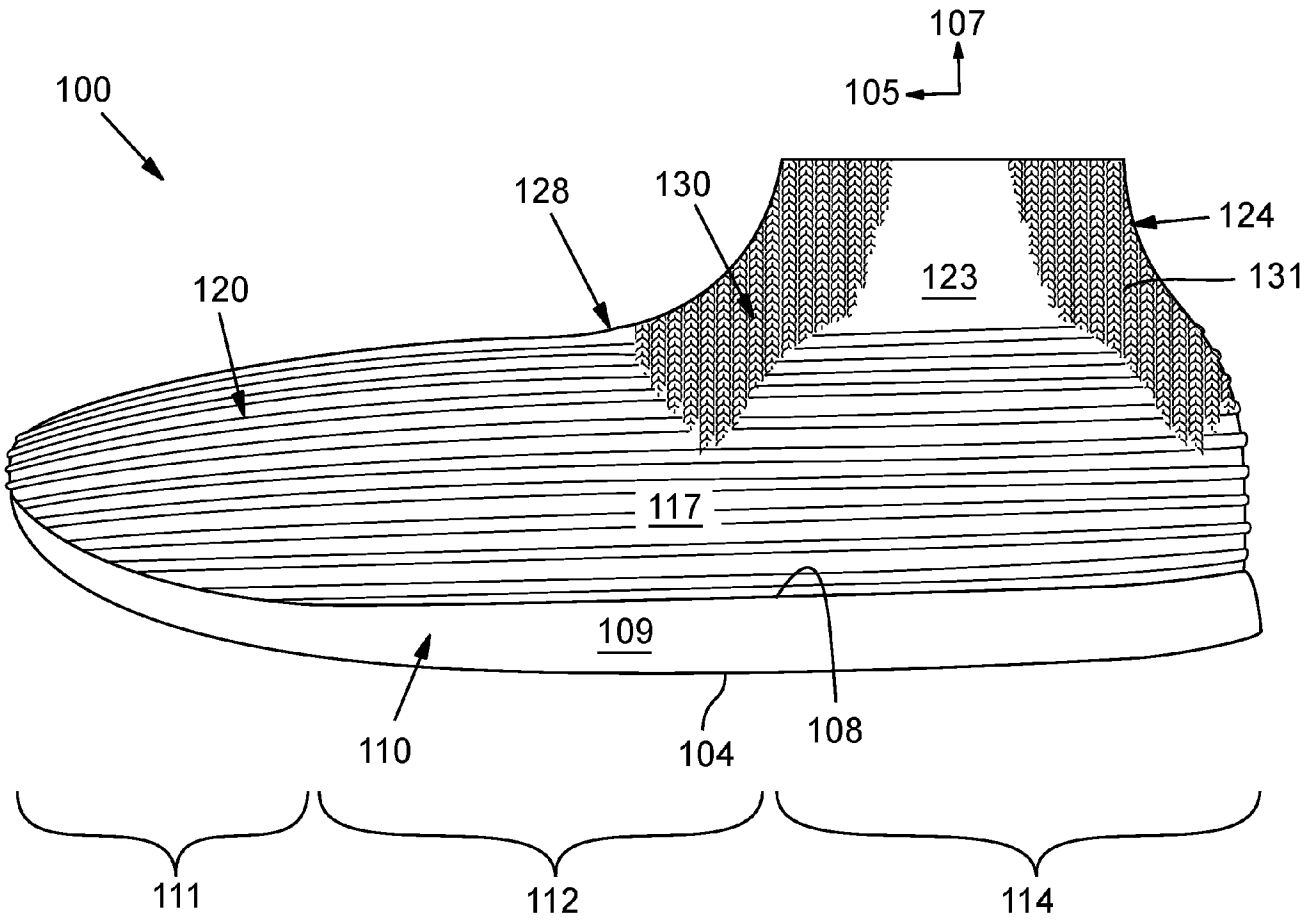
FIG. 3 is a medial side view of the article of footwear of FIG. 1.
Figure 4:
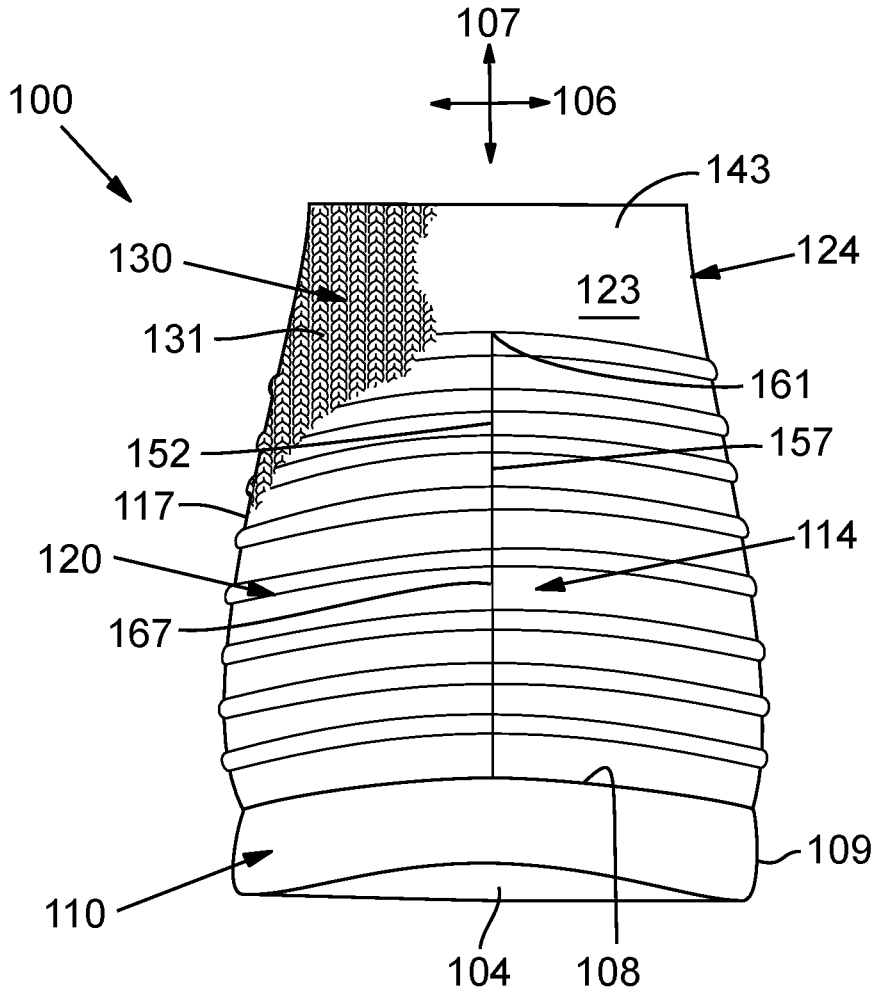
FIG. 4 is a rear view of the article of footwear of FIG. 1.

Embodiments of sole structure 110 will now be discussed with reference to FIGS. 2-4. Sole structure 110 can be secured to upper 120 and can extend between the wearer's foot and the ground when footwear 100 is worn. Sole structure 110 can be a uniform, one-piece member in some embodiments. Alternatively, sole structure 110 can include multiple components, such as an outsole, a midsole, and an insole, in some embodiments.

Also, sole structure 110 can include a ground-engaging surface 104. Ground-engaging surface 104 can also be referred to as a ground-contacting surface. Furthermore, sole structure 110 can include an upper surface 108 that faces the upper 120. Stated differently, upper surface 108 can face in an opposite direction from the ground-engaging surface 104. Upper surface 108 can be attached to upper 120. Also, sole structure 110 can include a side peripheral surface 109 that extends between ground engaging surface 104 and upper surface 108. Side peripheral surface 109 can extend generally along vertical axis 107. Side peripheral surface 109 can also extend substantially continuously about footwear 100 along forefoot region 111, lateral side 115, heel region 114, medial side 117 and back to forefoot region 111.

Embodiments of upper 120 will now be discussed in greater detail with reference to FIGS. 1-4. As shown, upper 120 can define a void 122 that receives a foot of the wearer. Stated differently, upper 120 can define an interior surface 121 that defines void 122, and upper 120 can define an exterior surface 123 that faces in a direction opposite interior surface 121. When the wearer's foot is received within void 122, upper 120 can at least partially enclose and encapsulate the wearer's foot. Thus, upper 120 can extend about forefoot region 111, lateral side 115, heel region 114, and medial side 117 in some embodiments.

Upper 120 can also include a collar 124. Collar 124 can include a collar opening 126 that is configured to allow passage of the wearer's foot during insertion or removal of the foot from the void 122.

Upper 120 can also include a throat 128. Throat 128 can extend from collar opening 126 toward forefoot region 111. Throat 128 dimensions can be varied to change the width of footwear 100 between lateral side 115 and medial side 117. Thus, throat 128 can affect fit and comfort of article of footwear 100.

In some embodiments, such as the embodiment of FIGS. 1-4, throat 128 can be a "closed" throat 128, in which upper 120 is substantially continuous and uninterrupted between lateral side 115 and medial side 117. As such, upper 120 can be sock-like in some embodiments. In other embodiments, throat 128 can include a throat opening between lateral side 115 and medial side 117. In these latter embodiments, footwear 100 can include a tongue that is disposed within throat opening. For example, in some embodiments, the tongue can be attached at its forward end to forefoot region 111, and the tongue can be detached from lateral side 115 and lateral side 117. Accordingly, the tongue can substantially fill the throat opening. Furthermore, in some embodiments, footwear 100 can include a shoelace, straps, buckles, or other securement devices that can extend across throat 128 and that can be used for varying the width of upper 120.

Many conventional footwear uppers are formed from multiple material elements (e.g., polymer foam, polymer sheets, leather, synthetic leather) that are joined together through stitching or bonding, for example. However, in various embodiments discussed herein, upper 120 can be at least partially formed from a knitted component 130. Knitted component 130 can at least partially extend through forefoot region 111, midfoot region 112, and/or heel region 114. Knitted component 130 can also extend along lateral side 115, medial side 117, over forefoot region 111, and/or around heel region 114. In addition, knitted component 130 can at least partially define exterior surface 123 and/or interior surface 121 of upper 120.

Knitted component 130 can provide upper 120 with weight savings as compared with other conventional uppers. Furthermore, knitted component 130 can be elastic and stretchable in some embodiments. Thus, knitted component 130 can stretch out to allow passage of the wearer's foot into and out of void 122 within footwear 100. Furthermore, when footwear 100 is worn, upper 120 can lightly compress and conform against the wearer's for added comfort and support. Additionally, knitted component 130 can provide the upper 120 with useful features, such as three-dimensionally curved areas, projections, recessed areas. Still further, knitted component 130 can be formed using efficient methods. These methods can increase manufacturing efficiency for footwear 100. Also, these methods can reduce the part count for the upper 120 and further increase manufacturing efficiency.

Knitted component 130 can be formed of unitary knit construction. As defined herein and as used in the claims, the term "unitary knit construction" means that knitted component 130 is formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn or other knit material that are joined such that the structures or elements include at least one course in common (i.e., sharing a common strand or common yarn) and/or include courses that are substantially continuous between each portion of knitted component 130. With this arrangement, a one-piece element of unitary knit construction is provided.

Although portions of knitted component 130 may be joined to each other following the knitting process, knitted component 130 remains formed of unitary knit construction because it is formed as a one-piece knit element. Moreover, knitted component 130 remains formed of unitary knit construction when other elements (e.g., an inlaid strand, a closure element, logos, trademarks, placards with care instructions and material information, and other structural elements) are added following the knitting process.

Thus, upper 120 can be constructed with a relatively low number of material elements. This can decrease waste while also increasing the manufacturing efficiency and recyclability of upper 120. Additionally, knitted component 130 of upper 120 can incorporate a smaller number of seams or other discontinuities. This can further increase manufacturing efficiency of footwear 100.

Embodiments of Knitted Component

Figure 5:
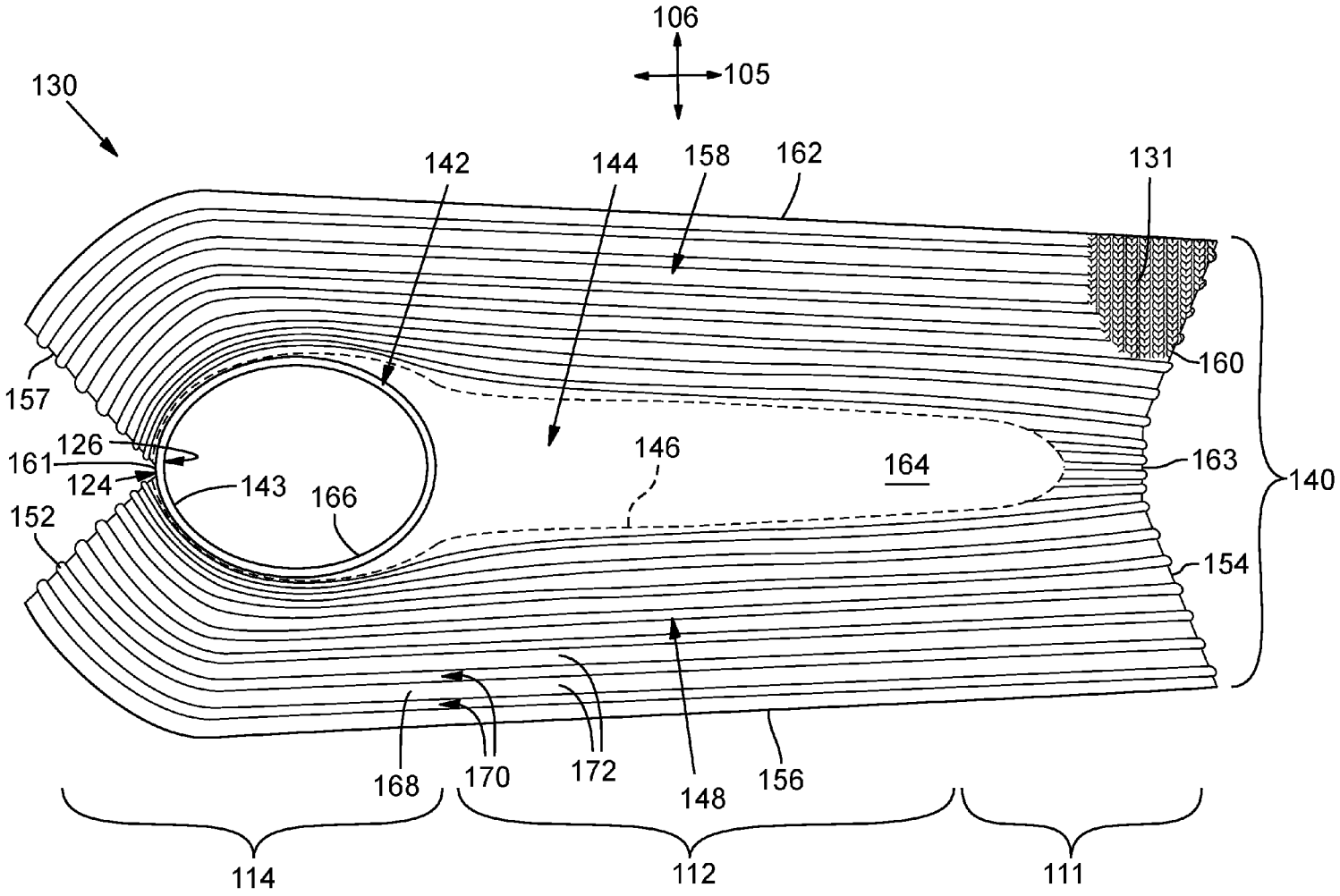
FIG. 5 is a plan view of the knitted component of the article of footwear of FIG. 1.
Figure 6:
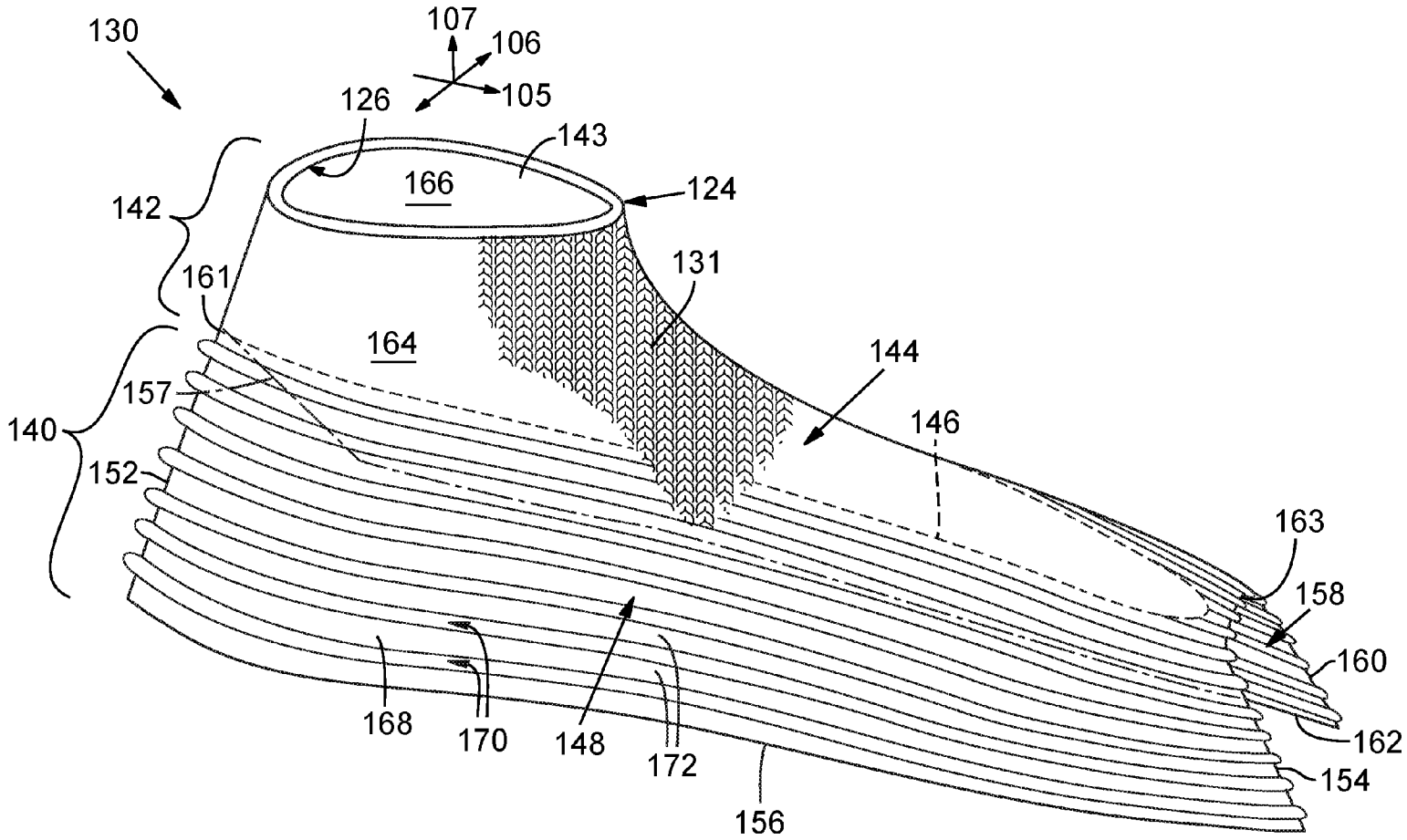
FIG. 6 is a perspective view of the knitted component of FIG. 5.

Knitted component 130 is illustrated in greater detail in FIGS. 5 and 6 according to exemplary embodiments. Knitted component 130 can generally include a knit element 131. Knit element 131 can define a majority of knitted component 130 in some embodiments. Also, in some embodiments, knitted component 130 can further include at least one tensile strand, tensile yarn, or other tensile element. Tensile element can be incorporated within and formed of unitary knit construction with knit element 131. Tensile element can be inlaid within one or more courses or wales of knit element 131 in some embodiments. Also, tensile element can provide stretch resistance to respective areas of knitted component 130. Although not specifically illustrated in the drawings, it will be appreciated that tensile elements can be included in any suitable area of knitted component 130. In some embodiments, knitted component 130, knit element 131, and/or tensile elements can incorporate the teachings of one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, both of which applications are hereby incorporated by reference in their entirety.

Knit element 131 of knitted component 130 may be formed from at least one yarn, cable, fiber, or other strand that is manipulated (e.g., with a knitting machine) to form a plurality of intermeshed loops that define a plurality of courses and wales.

Yarn(s) that form knit element 131 can be of any suitable type. For example, yarn of knit element 131 can be made from cotton, elastane, rayon, wool, nylon, polyester, or other material. Also, in some embodiments, one or more areas of knit element 131 can be made from yarn that is elastic and resilient. As such, the yarn can be stretched in length from a first length, and yarn can be biased to recover to its first length. Thus, such an elastic yarn can allow corresponding areas of knit element 131 to stretch elastically and resiliently under the influence of a force. When that force is reduced, knit element 131 can recover back its neutral position.

Furthermore, in some embodiments, one or more yarns of knit element 131 can be at least partially formed from a thermoset polymer material that can melt when heated and that can return to a solid state when cooled. As such, the yarn can be a fusible yarn and can be used to join two objects or elements together. In additional embodiments, knit element 131 can include a combination of fusible and non-fusible yarns. In some embodiments, for example, knitted component 130 and upper 120 can be constructed according to the teachings of U.S. Patent Publication No. 2012/0233882, which published on Sep. 20, 2012, and the disclosure of which is hereby incorporated by reference in its entirety.

Knit element 131 can generally include a foot part 140, a collar part 142, and a throat part 144. An imaginary boundary line (a broken line) is included in FIGS. 1-6 and is indicated at 146. The boundary line 146 demarcates the foot part 140 from the collar and throat parts 142, 144 according to exemplary embodiments of the present disclosure. It will be appreciated that the boundary between these areas could be routed differently along the knitted component 130 without departing from the scope of the present disclosure.

Collar part 142 can be configured to cover an ankle, shin, calf, Achilles tendon area, or other parts of the lower leg of the wearer. Collar part 142 can also define the collar 124 and collar opening 126 of the upper 120 discussed above with respect to FIGS. 1-4.

Furthermore, in some embodiments, collar part 142 can form a tube 143. Stated differently, tube 143 can define collar part 142 and can extend annularly and continuously with respect to the vertical axis 107. As such, collar part 142 can continuously extend about the leg, ankle, and/or foot of the wearer.

Throat part 144 can be attached to tube 143 of collar part 142 in midfoot region 112 and can extend along longitudinal axis 105 toward forefoot region 111. Throat part 144 can define 128 of upper 120 as discussed above. In some embodiments, throat part 144 can be formed of unitary knit construction with tube 143 of collar part 142.

Foot part 140 can include a first portion 148 and a second portion 158. First portion 148 and/or second portion 158 can be sheet-like in some embodiments. More specifically, first portion 148 can include a rear edge 152, a front edge 154, and a bottom edge 156. Rear edge 152 can be disposed in heel region 114 and can extend from tube 143. Front edge 154 can be disposed in forefoot region 111 and can extend from an area proximate throat part 144. Bottom edge 156 can extend between rear edge 152 and front edge 154. Likewise, second portion 158 can include a rear edge 157, a front edge 160, and a bottom edge 162. Rear edge 157 can be disposed in heel region 114 and can extend from tube 143. Front edge 160 can be disposed in forefoot region 111 and can extend from an area proximate throat part 144. Bottom edge 162 can extend between rear edge 157 and front edge 160.

Furthermore, in some embodiments, front edge 154 of first portion 148 can be connected at a forward junction 163 with front edge 160 of second portion 158. In some embodiments, front edge 154 and front edge 160 can be curved slightly.

Additionally, rear edge 152 of first portion 148 can be connected at a rear junction 161 with rear edge 157 of second portion 158. Rear junction 161 can be disposed proximate tube 143 of collar part 142 in heel region 114.

Moreover, in some embodiments, foot part 140 can be formed of unitary knit construction with collar part 142 and throat part 144. In other embodiments, collar part 142 and/or throat part 144 can be independent from foot part 140 and removably attached to foot part 140. For example, collar part 142 and throat part 144 can be joined to foot part 140 via adhesives, stitching, fasteners, or other attachment devices and methods. Additionally, in some embodiments, collar part 142, throat part 140, and foot part 140 can be included according to U.S. patent application Ser. No. 13/681,842, filed Nov. 20, 2012, and published as U.S. Patent Publication No. 2014/0137433 on May 22, 2014, and which is incorporated by reference in its entirety.

To assemble knitted component 130 and at least partially define upper 120, rear edge 152 and rear edge 157 can be attached at a seam 167. Seam 167 is shown in FIG. 4 according to exemplary embodiments. Rear edges 152, 157 can be attached via adhesive, stitching, fasteners, or other attachment devices and methods. Also, in some embodiments, bottom edge 156 and bottom edge 162 can be attached directly together to be disposed underneath the wearer's foot. In other embodiments, bottom edges 156, 162 can be attached indirectly via a secondary member, such as a strobel or strobel sock that extends under the foot. Furthermore, knit element 131 in forefoot region 111 can be extended and curved downward to define a cavity configured to receive the toes and forefoot of the wearer's foot.

Sole structure 110 can then be attached to knitted component 130, for example, by adhesives. In some embodiments, sole structure 110 can overlay bottom edge 156, bottom edge 162, front edge 154 and front edge 160. Assembled as such, knitted component 130 can define a majority of upper 120 with foot part 140 configured to receive and at cover a foot of the wearer. Also, as assembled, first portion 148 can define a majority of lateral side 115 of upper 120 and second portion 158 can define a majority of medial side 117 of upper 120. First portion 148 and second portion 158 can also define heel region 114 and forefoot region 111. Moreover, as mentioned above, collar part 142 can define collar 124 of upper 120 and throat part 144 can define throat 128 of upper 120.

Additionally, in some embodiments, an outer surface 164 of knitted component 130 can at least partially define exterior surface 123 of upper 120. Likewise, in some embodiments, an inner surface 166 of knitted component 130 can at least partially define interior surface 121 of upper 120. In additional embodiments, an exterior skin can be layered on outer surface 164 such that skin defines exterior surface 123 of upper 120. Additionally, in some embodiments, a lining can be attached to inner surface 166 such that the lining defines interior surface 121.

In some embodiments, outer surface 164 and/or inner surface 166 of knit element 131 can include one or more projections, ribs, bumps, or other areas that are raised relative to other areas. Conversely, in some embodiments, outer surface 164 and/or inner surface 166 can include one or more pockets, divots, or other areas that are recessed relative to other areas. As such the surfaces of knit element 131 can have predetermined unevenness, surface roughness, and/or waviness. This can provide desirable texture, tactile response, and/or frictional properties to knit element 131. For example, in some embodiments, footwear 100 can be used as a soccer or football shoe, and these surface features can increase ball control for the wearer. Moreover, in some embodiments, the unevenness of the surfaces of knit element 131 can affect the fit, stretchability, or other characteristic of upper 120.

For example, in some embodiments, outer surface 164 can include a recessed area 168 and a projected area 170.

Projected area 170 can project outward from recessed area 168. More specifically, in some embodiments, projected area 170 can be an elongate rib 172 that projects from recessed area 168. As such, recessed area 168 can be an elongate channel. However, it will be appreciated that projected area 170 and recessed area 168 can have any suitable shape.

Also, as shown in FIG. 6, inner surface 166 can include recessed area 168 and projected area 170. In some embodiments, projected areas 170 and recessed areas 168 on inner surface 166 can correspond to those on outer surface 164. For example, projected area 170 on outer surface 164 can overlay recessed area 168 on inner surface 166 and vice versa. As such, knit element 131 can have a corrugated, wavy, rippled, or otherwise uneven profile in cross section.

Recessed area 168 and/or projected area 170 can be formed using any suitable knit structure. For example, a ripple stitch structure known to one of ordinary skill in the art can be used to define ribs 172. Additionally, in some embodiments, projected area 170 can include tuck stitches for projecting from recessed area 168.

Moreover, projected area 170 and recessed areas 168 can be disposed in any suitable area of knit element 131. For example, in some embodiments represented in FIGS. 5 and 6, ribs 172 can extend continuously from rear edge 152 to front edge 154 of first portion 148. Likewise, in some embodiments, ribs 172 can extend continuously from rear edge 157 to front edge 160 of second portion 158.

Furthermore, in some embodiments, some areas of knit element 131 can include ribs 172 or other projected areas 170 while other areas are relatively even and smooth. For example, in some embodiments, foot part 140 of knit element 131 can include ribs 172, and ribs 172 can be absent from collar part 142 and throat part 144.

Additionally, in some embodiments, portions of knit element 131 can have different characteristics than other portions of knit element 131. For example, in some embodiments, different portions can have different elasticity, flexibility, softness, or other differences.

For example, in some embodiments, collar part 142 can be more elastic, stretchable, and resilient than foot part 140. In some embodiments, throat part 144 can be more elastic than foot part 140 as well. As such, collar part 142 and throat part 144 can be stretched, for example, when putting on or taking off footwear 100. However, collar part 142 and throat part 144 can recover back toward a neutral position and can compress toward the wearer's foot when worn. Also, foot part 140 can exhibit more stiffness for providing support to the foot. In some embodiments, the differences in elasticity of collar part 142, foot part 140, and throat part 144 can be a result of the yarns used to form these parts. Stated differently, the yarns of collar part 142 and throat part 144 can be more elastic and stretchable in length as compared to the yarns of foot part 140. In additional embodiments, foot part 140 can include a skin or other structures that make the foot part 140 less elastic than collar part 142 and throat part 144.

Accordingly, knitted component 130 can include various features that enhance the fit and comfort of upper 120 and article of footwear 100. Knitted component 130 can also include relatively few parts such that article of footwear 100 can be constructed efficiently and cost effectively. Additionally, knitted component 130 can be recyclable and can be knitted without generating a large amount of waste.

Embodiments of Methods of Knitting a Knitted Component

Referring now to FIGS. 7-13, methods of knitting knitted component 130 will be discussed in detail. As will be discussed, in some embodiments, the knitting methods can be used to form multiple corresponding portions of knitted component 130 substantially simultaneously. For example, knitted component 130 can include corresponding portions that define different, opposing sides of upper 120. The corresponding portions can be knitted substantially simultaneously. More specifically, as knitted component 130 is being knitted, different portions of knitted component 130 can grow away from the needle beds of a knitting machine. Knitted courses can be added to the corresponding portions causing this fabric growth. A first knitted course of one portion can be added as a second knitted course of a different portion is added.

Additionally, specific methods can be employed for utilizing a knitting machine, such as a flat knitting machine, to form the corresponding portions substantially simultaneously. These methods can increase efficiency, reduce waste, and allow knitted component 130 to be formed more inexpensively.

Figure 7:
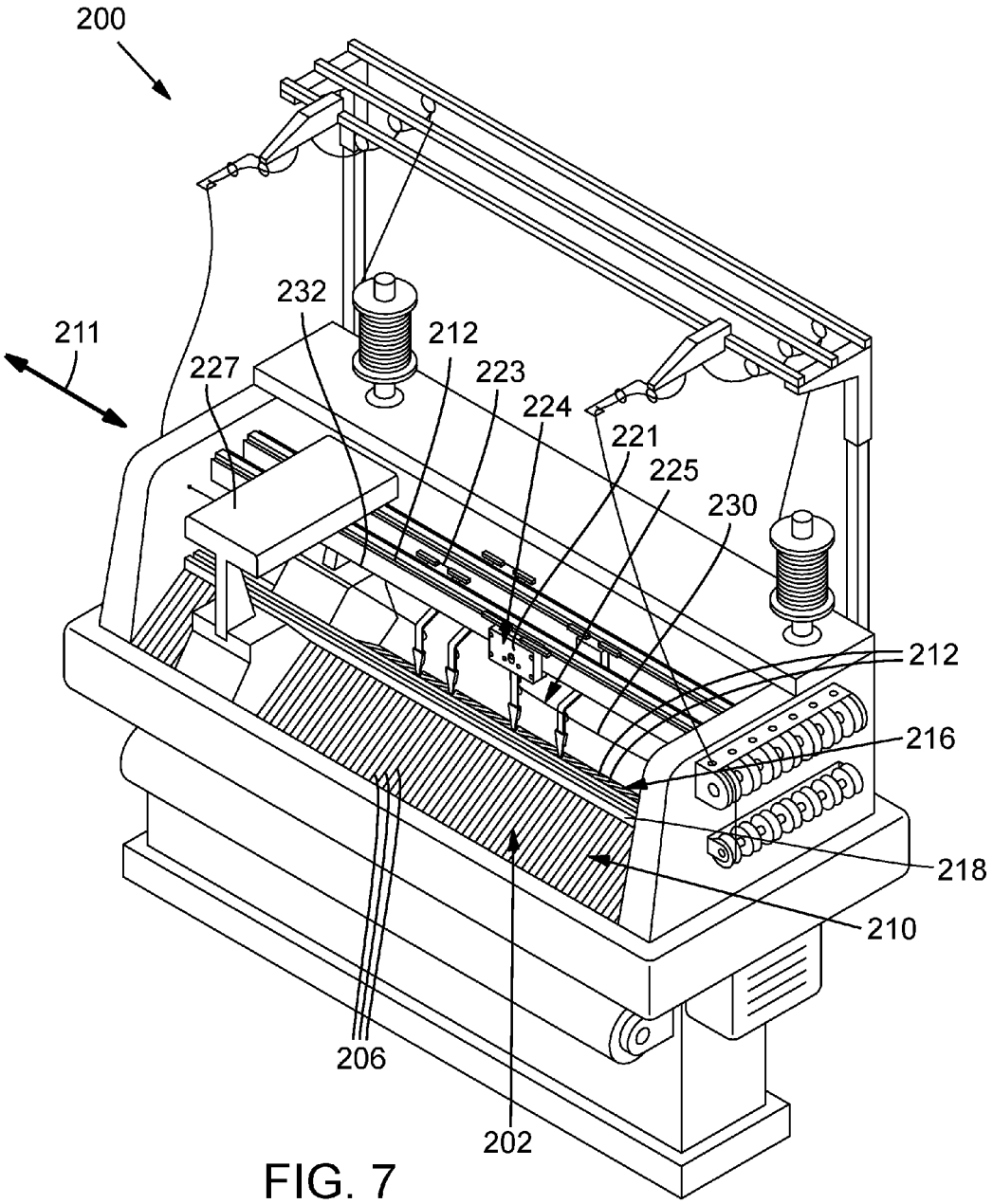
FIG. 7 is a perspective view of a knitting machine configured for knitting the knitted component of FIGS. 5 and 6.

Referring initially to FIG. 7, a knitting machine 200 is illustrated according to exemplary embodiments of the present disclosure. Knitting machine 200 can be of any suitable type, such as a flat knitting machine, a circular knitting machine, or other type. For example, knitting machine 200 of FIG. 7 has a configuration of a V-bed flat knitting machine as an exemplary embodiment. However, the knitting machine 200 can have different configurations without departing from the scope of the present disclosure.

Figure 13:
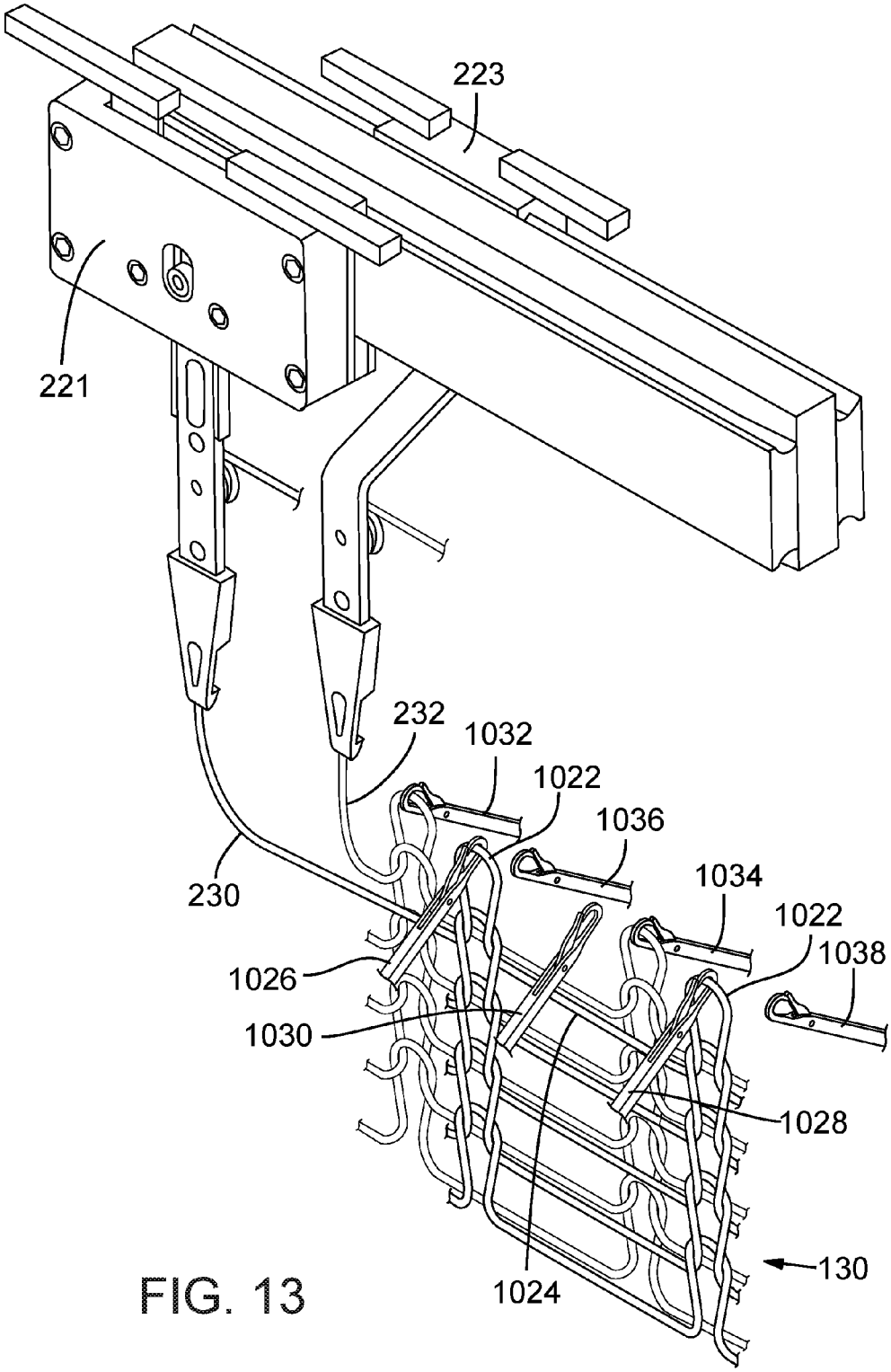
FIG. 13 is a perspective view of a portion of the knitting machine of FIG. 7 shown in the process of knitting the knitted component of FIGS. 5 and 6.

Knitting machine 200 can include a plurality of needles 202, which are illustrated schematically in FIG. 7 and in greater detail in FIG. 13. Needles 202 can include a plurality of first needles 206 and a plurality of second needles 212. First needles 206 can be arranged generally in a first bed 210 of knitting machine 200. In some embodiments, first bed 210 can be substantially planar. Similarly, second needles 212 can be arranged in a second bed 216, which can be substantially planar in some embodiments. It will be appreciated that first bed 210 can be referred to as a "front bed," and second bed 216 can be referred to as a "rear bed."

First bed 210 and/or second bed 216 can extend along a relatively straight longitudinal axis 211. Furthermore, first bed 210 and second bed 216 can be spaced apart from each other as shown in FIG. 7 to define a gap 218 between first and second beds 210, 216. Also, first bed 210 and second bed 216 can be disposed at a positive angle relative to each other.

Knitting machine 200 can further include one or more rails 222. Rails 222 can be elongate and can extend substantially parallel to the longitudinal axis 211. Rails 222 can provide attachment points for one or more yarn feeders 224.

Feeders 224 can move longitudinally along the respective rail 222 while feeding yarn 225 toward needles 202. It will be appreciated that feeders 224 can be configured to feed any type of yarn, fiber, wire, cable, filament, or other strand toward needles 202. Additionally, feeders 224 and other features of knitting machine 200 can be configured according to the teachings of U.S. Pat. No. 8,522,577, which issued on Sep. 3, 2013, and which is incorporated by reference in its entirety.

Figure 9:
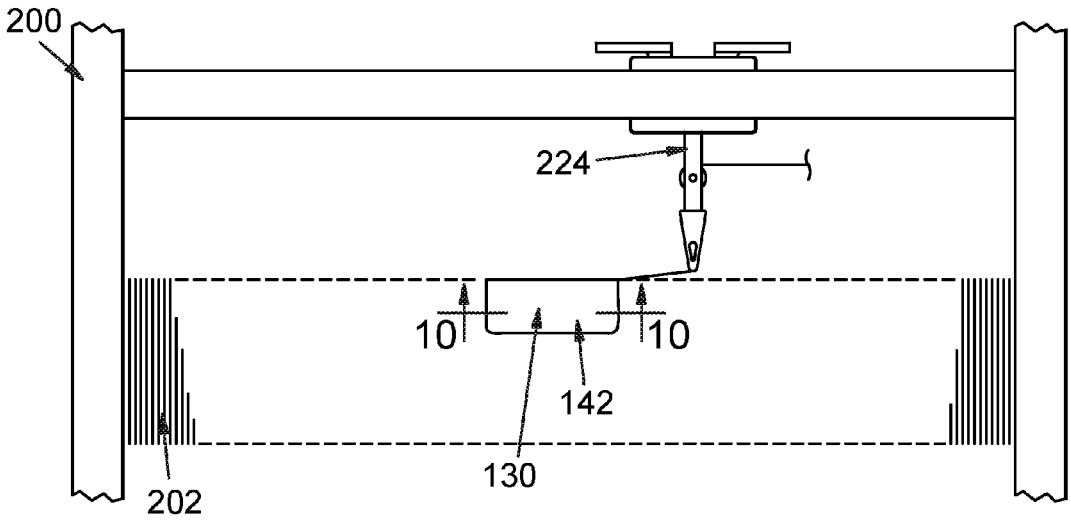
FIG. 9 is a schematic view of a portion of the knitting machine of FIG. 7 shown in the process of knitting the knitted component of FIGS. 5 and 6.
Figure 11:
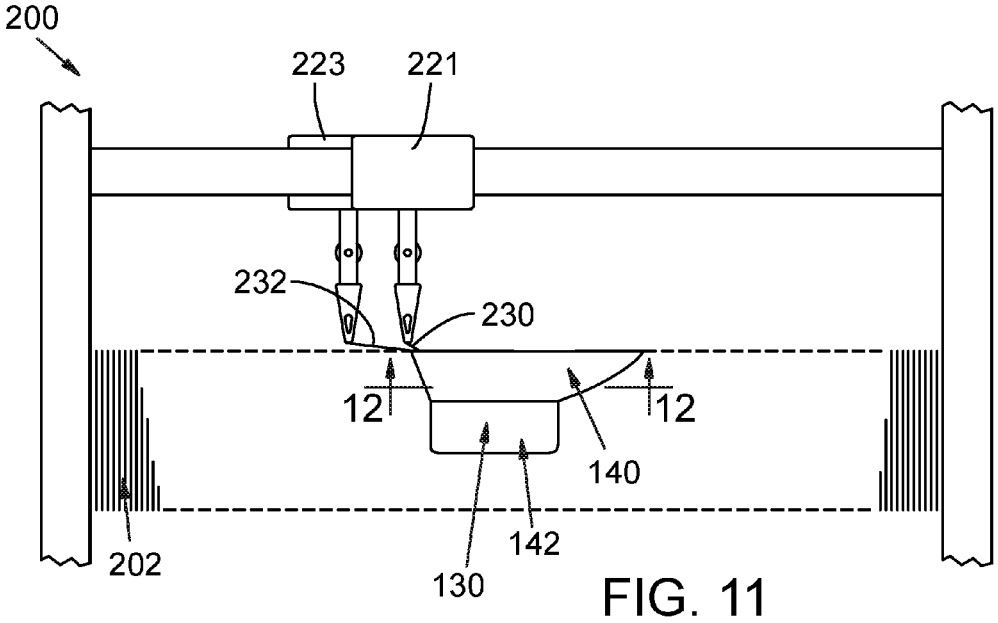
FIG. 11 is a schematic view of a portion of the knitting machine of FIG. 7 shown in the process of knitting the knitted component of FIGS. 5 and 6.

Needles 202 can receive yarn 225 and can perform various knitting procedures for incorporating yarn 225 into a knitted component 130 as represented in FIGS. 9, 11, and 13. For example, needles 202 can knit, tuck, float, inlay, or otherwise manipulate yarn 225 to form knitted component 130.

In some embodiments, feeders 224 can include a first feeder 221 and a second feeder 223, which are used in combination to form knitted component 130. In some embodiments, first feeder 221 can feed a first yarn 230 toward first needle bed 210 and/or second needle bed 216. Second feeder 223 can feed a second yarn 232 toward first needle bed 210 and/or second needle bed 216. However, it will be appreciated that knitted component 130 can be at least partially knitted using a single feeder 224 and/or using a single yarn 225 in some embodiments. Moreover, it will be appreciated that knitted component 130 can be at least partially knitted using more than two feeders 224 and/or using more than two yarns 225 in some embodiments.

First and second feeders 221, 223 can be attached to and supported by a common rail 222. In some embodiments, first feeder 221 can be attached to a front side of rail 222 and second feeder 223 can be attached to a rear side of rail 222. Both first and second feeders 221, 223 can be actuated along rail 222 by a carriage 227. As such, first and second feeders 221, 223 can slide back-and-forth along rail 222, parallel to the longitudinal axis 211.

Figure 8:
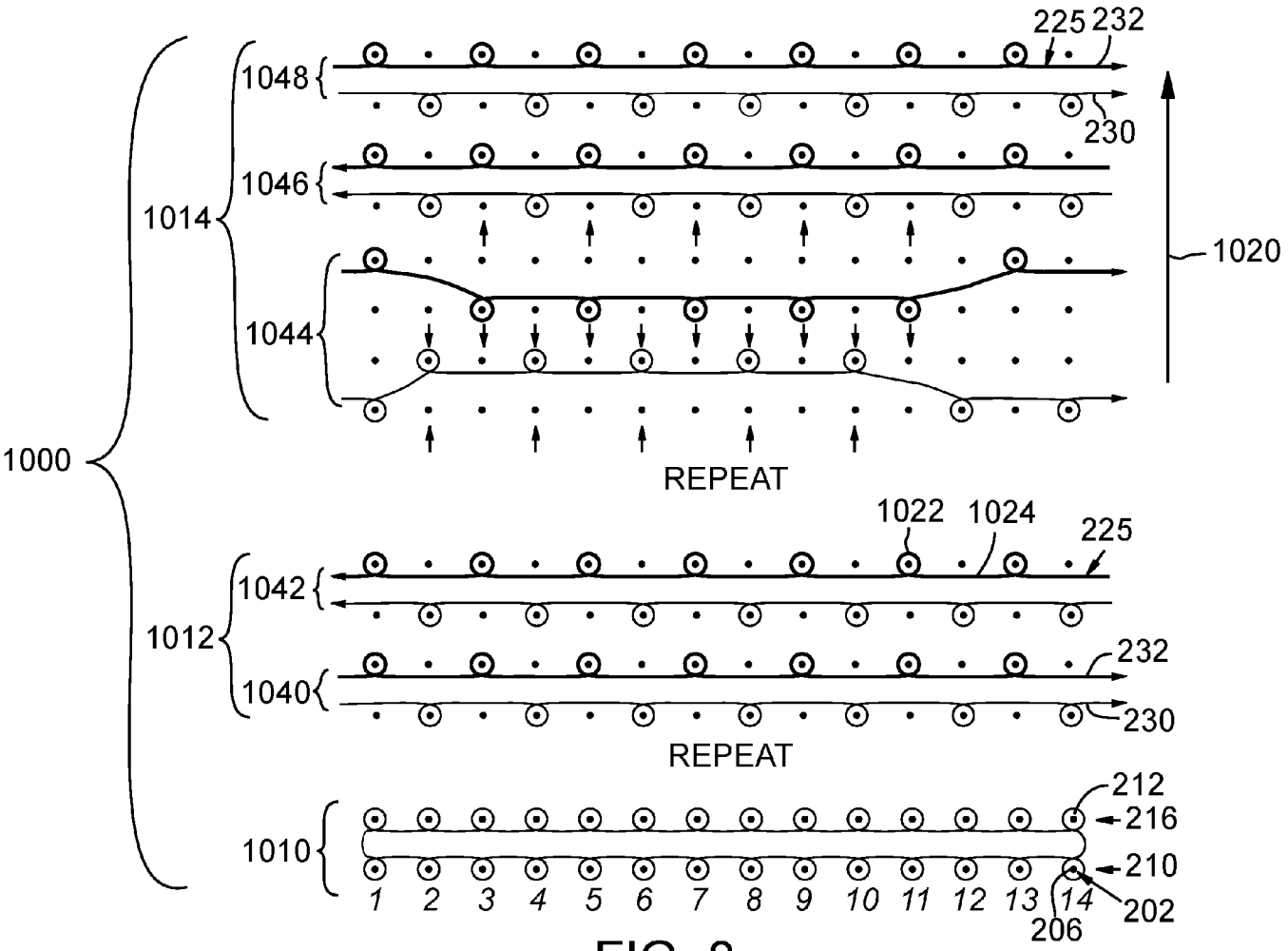
FIG. 8 is a diagram illustrating a method of knitting the knitted component of FIGS. 5 and 6.

FIG. 8 is a diagram illustrating a method 1000 of knitting knitted component 130 according to exemplary embodiments. FIGS. 9-13 are schematic representations of portions of the knitting machine that further illustrate the method of FIG. 8.

The method 1000 of FIG. 8 is divided into a first sequence 1010, a second sequence 1012, and a third sequence 1014, which each represent knitting steps and/or methods for knitting different areas of knitted component 130 as will be explained in detail. It will be appreciated, however, that the steps, sequences, repetitions of steps, and other factors can be varied from those shown in FIG. 8 without departing from the scope of the present disclosure.

Furthermore, FIG. 8 represents needles 202 with dots that are aligned horizontally in rows. Positions of the needles 202 are indicated at the bottom of the page with numbers 1 through 14 for reference purposes. It will be appreciated that the needles 202 in positions 1 through 14 can represent first needles 206 of the first bed 210 of the knitting machine 200 as well as second needles 212 of the second bed 216. It will also be appreciated that needles 202 in positions 1 through 14 can be representative of additional needles 202 within beds 210, 216.

Knitted component 130 can grow in a fabric growth direction, which is indicated with an upwardly pointed arrow 1020 in FIG. 8. Yarns 225 are also indicated with elongate lines extending primarily along the horizontal direction. For purposes of clarity, first yarn 230 is indicated with a line of lighter weight than the line of second yarn 232.

As represented in FIGS. 8-13, at least one yarn 225 can be fed toward needles 202 with feeders 224, and needles 202 at predetermined locations can form loops 1022 that interlock with previously-formed loops to form knitted component 130. Also, floats 1024 can be formed at predetermined needle locations. Stated differently, floats 1024 can be formed between predetermined pairs of loops 1022. These knit structures and the method of creating the structures can allow multiple portions to be knit substantially simultaneously.

Figure 10:
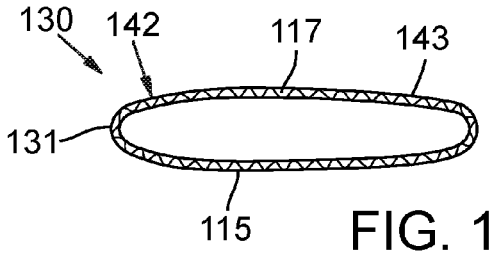
FIG. 10 is a section view of the knitted component taken along the line 10-10 of FIG. 9.

In some embodiments shown in FIGS. 8, 9, and 10, collar part 142 of knitted component 130 can be formed initially. For example, as shown in FIG. 8, yarn 225 can be fed to first needles 206 of first bed 210 and to second needles 212 of second bed 216 to form collar part 142. This process is represented in the first sequence 1010 in FIG. 8 according to some embodiments.

As shown, loops 1022 can be formed at each needle position 1 through 14 when forming collar part 142 in some embodiments. More specifically, in some embodiments, first yarn 230 can be fed to each first needle 206 in a first pass beginning at position 1 and ending at position 14, and loops 1022 can be formed at each position. Then, first yarn 230 can be fed to each second needle 212 at a second pass beginning at position 14 and ending at position 1, and loops 1022 can be formed at each position. As shown in FIG. 8, this process can be repeated, and additional courses of loops 1022 can be added and interlocked with previously formed loops 1022. In some embodiments, this can result in a tubular knit structure that defines tube 143 of knitted component 130.

Figure 12:
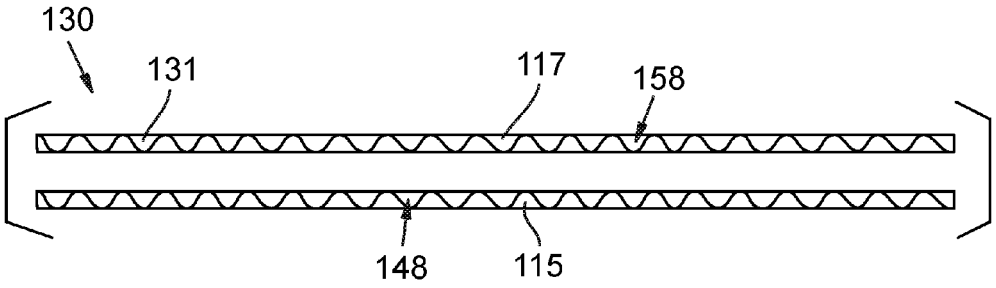
FIG. 12 is a section view of the knitted component taken along the line 12-12 of FIG. 11.

Next, in some embodiments, first portion 148 and second portion 158 of knitted component 130 can be formed as represented in second sequence 1012 of FIG. 8 and generally in FIGS. 11-13. In some embodiments, corresponding areas of first portion 148 and second portion 158 can be formed substantially simultaneously.

In some embodiments, for example, needles 202 of both first bed 210 and second bed 216 can be used to knit separate and opposing portions of knitted component 130. As such, opposing sides of the knitted component 130 can be knitted substantially simultaneously. More specifically, in some embodiments, first needles 206 of first bed 210 can be used to knit an area of first portion 148 of knitted component 130. Also, second needles 212 of second bed 216 can be used to knit an opposing area of second portion 158 of knitted component 130.

For example, to form first portion 148 in some embodiments, first feeder 221 can feed first yarn 230 toward first needles 206 of first bed 210 in a first pass 1040 along the needle beds 210, 216. First pass 1040 is directed to the right hand side of the page in FIG. 8 as an example. A predetermined group of the first needles 206 can receive first yarn 230 and form loops 1022. Also, in this pass of first feeder 221, first feeder 221 can bypass or skip others of the first needles 206 and create floats 1024 at those locations. Specifically, in some embodiments represented in FIG. 8, loops 1022 can be formed at needle positions 2, 4, 6, 8, 10, 12, and 14, and floats 1024 can be formed at needle positions 1, 3, 5, 7, 9, 11, and 13. This is further illustrated in FIG. 13, wherein loops 1022 are formed using a first active front needle 1026 and a second active front needle 1028, and wherein a float 1024 is formed proximate a first empty front needle 1030.

Also, to form second portion 158 in some embodiments, second feeder 223 can feed second yarn 232 toward second needles 212 of second bed 216 in the same pass 1040 along the needle beds 210, 216. A predetermined group of the second needles 212 can receive second yarn 232 and form loops 1022. Also, in this pass of second feeder 223, second feeder 223 can bypass or skip others of the second needles 212 and create floats 1024 at those locations. For example, as shown in FIG. 8, loops 1022 can be formed at needle positions 1, 3, 5, 7, 9, 11, and 13, and floats 1024 can be formed at needle positions 2, 4, 6, 8, 10, 12, and 14. This is further illustrated in FIG. 13, wherein loops 1022 are formed using a first active rear needle 1032 and a second active rear needle 1034, and wherein a float 1024 is formed proximate a first empty rear needle 1036 and a second empty rear needle 1038.

In some embodiments, first and second feeders 221, 223 can move substantially in synchronization and in the same direction during first pass 1040 as first and second portions 148, 158 of knitted component 130 are formed. However, as shown in FIG. 9, one of the first and second feeders 221, 223 can lag the other during the first pass 1040. Moreover, it will be appreciated that first feeder 221 and second feeder 223 can move in opposite directions during first pass 1040 without departing from the scope of the present disclosure. In these embodiments, loops 1022 of first portion 148 and loops 1022 of second portion 158 are added substantially simultaneously. More specifically, the position of the knitted course added to the first portion 148 in the first pass 1040 can correspond to the position of the knitted course added to the second portion 158.

Next, as shown in FIG. 8, additional courses of loops 1022 and floats 1024 can be added to first and second portions 148, 158 of knitted component 130 in a second pass 1042. In some embodiments, first feeder 221 and second feeder 223 can move in the same direction with respect to needle beds 210, 216 during the second pass 104 during the second pass 1042. In the embodiment of FIG. 8, for example, second pass 1042 is directed to the left hand side of the page.

First pass 1040 and second pass 1042 can be repeated as necessary as shown in FIG. 8. As such, knit courses can be added in succession, interlocking newly formed loops 1022 to previously-formed loops to form first portion 148, and knit courses can be similarly added to form second portion 158 of knitted component 130. For example, as shown in FIG. 8, the interlocked loops 1022 of first portion 148 can be formed with the group of first needles 206 at positions 2, 4, 6, 8, 10, 12, and 14. Meanwhile, the floats 1024 can be formed proximate first needles 206 at intervening positions 1, 3, 5, 7, 9, 11, and 13. Also, interlocked loops 1024 of second portion 158 can be formed with the group of second needles 212 at positions 1, 3, 5, 7, 9, 11, and 13. Meanwhile, the floats 1024 can be formed proximate second needles 212 at intervening positions 2, 4, 6, 8, 10, 12, and 14.

Thus, in the embodiment of FIG. 8, first needles 206 forming loops 1022 in first pass 1040 and second pass 1042 can be spaced apart at an interval with floats 1024 that are proximate intervening first needles 206. In the illustrated embodiments, every other first needle 206 forms loops 1022. Accordingly, the group of first needles 206 forming loops 1022 are spaced apart at a half-gauge interval. This results in a so-called half gauge knit structure. It will be appreciated, however, that the group of first needles 206 forming loops 1022 can be spaced apart at another interval without departing from the scope of the present disclosure.

Likewise, second needles 212 forming loops 1022 in first pass 1040 and second pass 1042 can be spaced apart at an interval with floats 1024 that are proximate intervening second needles 212. In the illustrated embodiments, every other second needle 212 forms loops 1022. Accordingly, the group of second needles 212 forming loops 1022 are spaced apart at a half-gauge interval. This results in a so-called half gauge knit structure. It will be appreciated, however, that the group of first needles 206 forming loops 1022 can be spaced apart at another interval without departing from the scope of the present disclosure.

It will also be appreciated that the group of first needles 206 forming loops 1022 of first portion 148 is offset along the longitudinal axis 211 relative to the group of second needles 212 forming loops 1022 of second portion 158. For example, the group of first needles 206 forming first portion 148 is offset by a single needle interval relative to the group of second needles 212 forming second portion 158. As a result, first portion 148 and second portion 158 can be formed substantially simultaneously and, yet, can remain detached as illustrated in FIG. 12.

Additionally, in some embodiments, ribs 172 can be formed on first portion 148 and/or second portion 158 using method 1000. In some embodiments, method 1000 can continue according to third sequence 1014 to form ribs 172. Third sequence 1014 can include a transfer sequence 1044, wherein loops 1022 being held in one bed are transferred to the opposite bed and vice versa.

In some embodiments, loops 1022 being held in first needles 206 can be transferred to second needles 212. Specifically, as shown in FIG. 8, loops 1022 at needle positions 2, 4, 6, 8, and 10 can be transferred to second needles 212 at needle positions 2, 4, 6, 8, and 10.

Then, first feeder 221 can travel along needle beds 210, 216. During this pass, loops 1022 can be formed with first needles 206 at needle positions 1, 12, and 14, and loops 1022 can be formed with second needles 212 at needle positions 2, 4, 6, 8, and 10.

Next, loops 1022 in second needles 212 at needle positions 2 through 11 can be transferred to corresponding needles in first bed 210. Subsequently, second feeder 223 can travel along needle beds 210, 216. During this pass, loops 1022 can be formed with first needles at needle positions 3, 5, 7, 9, and 11, and loops 1022 can be formed with second needles 212 at needle positions 1 and 13. Then, loops 1022 held in first needles 206 at needle positions 3, 5, 7, 9, and 11 can be transferred to second needles 212 at positions 3, 5, 7, 9, and 11.

After transfer sequence 1044, a third pass 1046 can occur. As shown, third pass 1046 can be substantially similar to second pass 1042. Thus, loops 1022 can be formed with first yarn 230 at needle positions 2, 4, 6, 8, 10, 12, and 14, and loops 1022 can be formed with second yarn 232 at needle positions 1, 3, 5, 7, 9, 11, and 13. Next, method 100 can be used according to fourth pass 1048. As shown, in fourth pass 1048, loops 1022 can be formed with first yarn 230 at needle positions 2, 4, 6, 8, 10, 12, and 14, and loops 1022 can be formed with second yarn 232 at needle positions 1, 3, 5, 7, 9, 11, and 13. These steps can be repeated as necessary.

It will be appreciated that these steps can be used for forming ribs 172 on first portion 148 and second portion 158 of knitted component 130. Ribs 172 can be formed substantially simultaneously as defined herein. This is because the rib 172 formed on first portion 148 can be formed at substantially the same time and at a location corresponding to the rib 172 formed on second portion 148.

The method 1000 can continue until the foot part 140 of knitted component 130 is completed. Then, upper 120 can be assembled and sole structure 110 can be added as discussed above to complete article of footwear 100.

Thus, the method 1000 can be used to form the knitted component 130 in a relatively quick and efficient manner. In some embodiments, areas of medial side 117 of upper 120 can be knitted substantially simultaneously as corresponding areas of lateral side 115 are formed. Moreover, relatively little waste can be created using the method 1000.

While various embodiments have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims. Moreover, as used in the claims "any of" when referencing the previous claims is intended to mean: (i) any one claim; or (ii) any combination of two or more claims referenced.

What is claimed is:

1. A method of knitting a knitted component for an article of footwear using a knitting machine, wherein the knitting machine includes a first needle bed with a plurality of first needles arranged along a longitudinal axis, and wherein the knitting machine includes a second needle bed with a plurality of second needles arranged along the longitudinal axis, wherein the method comprises:

performing a pass of at least one yarn feeder along the longitudinal axis relative to the first and second needle beds;

feeding at least one yarn with the at least one feeder during the pass;

forming, during the pass, a plurality of first loops with the first needles to define a first portion of the knitted component;

forming, during the pass, a plurality of second loops with the second needles to define a second portion of the knitted component;

wherein the first portion defines a medial side of an upper for the article of footwear; and wherein the second portion defines a lateral side of the upper for the article of footwear.

2. The method of claim 1, wherein performing the pass includes performing a pass of a first yarn feeder and a second yarn feeder along the longitudinal axis;

wherein feeding the at least one yarn includes:

feeding a first yarn with the first yarn feeder during the pass and forming the plurality of first loops with the first needles using the first yarn; and feeding a second yarn with the second yarn feeder during the pass and forming the plurality of second loops with the second needles using the second yarn.

3. The method of claim 1, wherein forming the plurality of first loops includes forming the plurality of first loops at a plurality of first needle positions;

further comprising forming first floats with the first yarn at other predetermined first needle positions;

wherein forming the plurality of second loops includes forming the plurality of second loops at a plurality of second needle positions; and further comprising forming second floats with the second yarn at other predetermined second needle positions.

4. The method of claim 1, wherein forming the plurality of first loops and forming the plurality of second loops includes offsetting the plurality of first loops from the plurality of second loops along the longitudinal axis.

5. The method of claim 1, further comprising transferring the first loops to corresponding ones of the plurality of second loops of the second bed; and further comprising transferring the second loops to corresponding ones of the plurality of first loops of the first bed.

6. A method of knitting a knitted component comprising a first portion and a second portion, the first portion configured to at least partially define a first side of an article of footwear, the second portion configured to at least partially define a second side of the article of footwear, the first side being opposite the second side, the method comprising:

providing a knitting machine having a plurality of first needles arranged in a first bed and a plurality of second needles arranged in a second bed, the first and second beds extending along an axis;

feeding at least one yarn to the first bed and forming a plurality of first loops with a first group of the first needles, the first loops formed with a first neighboring area of the knitted component to at least partially define the first portion of the knitted component;

feeding the at least one yarn to the second bed and forming a plurality of second loops with a second group of the second needles, the second loops formed with a second neighboring area of the knitted component to at least partially define the second portion of the knitted component;

wherein feeding the at least one yarn to the first bed includes forming floats at a plurality of first intervening needles of the first bed, the first intervening needles each disposed between pairs of the first needles in the first group;

wherein feeding the at least one yarn to the second bed includes forming floats at a plurality of second intervening needles of the second bed, the second intervening needles each disposed between pairs of the second needles in the second group; and wherein the first group of the first needles is offset relative to the second group of the second needles along the axis.

7. The method of claim 6, wherein the at least one yarn includes a first yarn and a second yarn;

wherein feeding the at least one yarn to the first bed includes feeding the first yarn to the first bed and forming the plurality of first loops from the first yarn; and wherein feeding the at least one yarn to the second bed includes feeding the second yarn to the second bed and forming the plurality of second loops from the second yarn.

8. The method of claim 6, wherein the first needles of the first group are spaced apart at a first interval that is less than full-gauge;

wherein the second needles of the second group are spaced apart at a second interval that is less than full-gauge; and wherein the first interval is equal to the second interval.

9. The method of claim 6, further comprising forming a surface of the knitted component, the surface spanning one of the first portion and the second portion;

further comprising forming a recessed area and a projected area of the surface, wherein the projected area projects outward from the recessed area.

10. The method of claim 6, wherein the projected area is an elongate rib that projects from the recessed area.

11. The method of claim 6, further comprising transferring the first loops to the second bed and transferring the second loops to the first bed.

12. The method of claim 6, further comprising forming a plurality of third loops with a third group of needles of the second bed and forming a plurality of fourth loops with a fourth group of needles of the first bed.

13. The method of claim 6, wherein the first portion and the second portion define a foot part of the knitted component, the foot part configured to cover a foot of a wearer; and further comprising forming a collar part of the knitted component;

wherein the collar part defines a collar opening configured to receive the foot.

14. The method of claim 6, wherein providing the knitting machine includes providing a flat knitting machine, wherein the first bed is substantially planar, the second bed is substantially planar, and wherein the first bed is disposed at a positive angle relative to the second bed.

15. A method of knitting a knitted component comprising a first portion and a second portion, the first portion configured to at least partially define a medial side of the article of footwear, the second portion configured to at least partially define a lateral side of the article of footwear, the method comprising:

providing a knitting machine having a plurality of first needles arranged in a first bed and a plurality of second needles arranged in a second bed, the first and second beds extending along a longitudinal axis;

feeding at least one yarn to the first bed and forming a plurality of first loops with a first group of the first needles, wherein the first needles of the first group are spaced apart at a first interval that is less than full-gauge, the first loops formed with a first neighboring area of the knitted component to at least partially define the first portion of the knitted component; and feeding the at least one yarn to the second bed and forming a plurality of second loops with a second group of the second needles, wherein the second needles of the second group are spaced apart at a second interval that is less than full-gauge, the second loops formed with a second neighboring area of the knitted component to at least partially define the second portion of the knitted component;

wherein the first group of the first needles is offset relative to the second group of the second needles along the longitudinal axis and optionally wherein the first interval is equal to the second interval.

16. The method of claim 15, wherein the first interval and the second interval is a half-gauge interval.

17. The method of claim 15, further comprising forming a surface of the knitted component, the surface spanning one of the first portion and the second portion;

further comprising forming a recessed area and a projected area of the surface, wherein the projected area projects outward from the recessed area.

18. The method of claim 15, further comprising transferring the first loops to the second bed and transferring the second loops to the first bed.

19. The method of claim 15, further comprising forming a plurality of third loops with a third group of needles of the second bed and forming a plurality of fourth loops with a fourth group of needles of the first bed.

20. The method of claim 15, wherein the first portion and the second portion define a foot part of the knitted component, the foot part configured to cover a foot of a wearer; and further comprising forming a collar part of the knitted component, wherein the collar part defines a collar opening configured to receive the foot, optionally wherein the collar part has greater elasticity than the foot part.

* * * * *